US012661709B2

(12) United States Patent
Ohide et al.

(10) Patent No.: US 12,661,709 B2
(45) Date of Patent: Jun. 23, 2026

(54) ATOMIZED POWDER, THERMAL SPRAY COATING, HEARTH ROLL, AND METHOD FOR PRODUCING HEARTH ROLL

(71) Applicants: TOCALO Co., Ltd., Kobe (JP); Sanyo Special Steel Co., Ltd., Himeji (JP)

(72) Inventors: Yuhei Ohide, Akashi (JP); Tatsuo Suidzu, Akashi (JP); Toshiyuki Sawada, Himeji (JP); Tomoki Hirono, Himeji (JP)

(73) Assignees: TOCALO Co., Ltd, Kobe (JP); Sanyo Special Steel Co., Ltd., Himeji (JP)

( * ) Notice: Subject to any disclaimer, the term of this patent is extended or adjusted under 35 U.S.C. 154(b) by 0 days.

(21) Appl. No.: 18/577,825

(22) PCT Filed: Jul. 15, 2022

(86) PCT No.: PCT/JP2022/027814

§ 371 (c)(1),
(2) Date: Jan. 9, 2024

(87) PCT Pub. No.: WO2023/008225

PCT Pub. Date: Feb. 2, 2023

(65) Prior Publication Data

US 2024/0342793 A1 Oct. 17, 2024

(30) Foreign Application Priority Data

Jul. 27, 2021 (JP) ..... 2021-122668

(51) Int. Cl.
*B22F 1/12* (2022.01)
*C22C 27/06* (2006.01)
(Continued)

(52) U.S. Cl.
CPC ..... *B22F 1/12* (2022.01); *C22C 27/06* (2013.01); *C22C 30/00* (2013.01);
(Continued)

(58) Field of Classification Search
None
See application file for complete search history.

(56) References Cited

U.S. PATENT DOCUMENTS 5,652,028 A * 7/1997 Taylor ..... C23C 4/10 427/451
6,071,324 A 6/2000 Laul et al.
(Continued)

FOREIGN PATENT DOCUMENTS

CN 101862825 A 10/2010
EP 0834585 A1 4/1998
(Continued)

OTHER PUBLICATIONS

Zhu, et al "Microstructure and Sliding Wear Performance of Cr7C3-(Ni,Cr)3(Al,Cr) Coating Deposited from Cr7Cr In Situ Formed Atomizing Powder", J Therm Spray Tech (2017) 26:254-264. (Year: 2016).*
(Continued)

*Primary Examiner* — David C Mellon
(74) *Attorney, Agent, or Firm* — Faegre Drinker Biddle & Reath LLP

(57) ABSTRACT

An atomized powder has a heat-resistant alloy phase and a $Cr_7C_3$ phase dispersed in the heat-resistant alloy phase, and contains 20 to 46% of Ni, 22 to 43% of Cr, 4 to 13% of Al, 0.1 to 1.0% of Y, and 0.3 to 4.2% of C on a mass basis, and a remainder thereof includes Co and unavoidable impurities.

7 Claims, 9 Drawing Sheets

GAS-ATOMIZED POWDER, 20 wt% $Cr_7C_3$-CoNiCrAlY

GRANULATED SINTERED POWDER, 40 wt% $Cr_3C_2$-CoNiCrAlY

(51) Int. Cl.

| | |
|---|---|
| ***C22C 30/00*** | (2006.01) |
| ***C22C 32/00*** | (2006.01) |
| ***C23C 4/073*** | (2016.01) |
| ***C23C 4/10*** | (2016.01) |
| ***C23C 4/134*** | (2016.01) |

(52) U.S. Cl.

CPC ..... *C22C 32/0052* (2013.01); *C23C 4/073* (2016.01); *C23C 4/10* (2013.01); *C23C 4/134* (2016.01); *B22F 2301/15* (2013.01); *B22F 2302/10* (2013.01)

(56) References Cited

U.S. PATENT DOCUMENTS

| | | | | |
|---|---|---|---|---|
| 6,548,161 | B1 * | 4/2003 | Torigoe | F01D 5/288 428/472 |
| 2008/0241522 | A1 | 10/2008 | Mizuno et al. | |
| 2010/0230874 | A1 | 9/2010 | Kurisu et al. | |
| 2020/0353537 | A1 * | 11/2020 | Perez | C22C 19/07 |
| 2022/0380862 | A1 | 12/2022 | Kurisu et al. | |
| 2024/0133015 | A1 * | 4/2024 | Vecchio | C23C 4/137 |
| 2024/0229215 | A9 * | 7/2024 | Vecchio | C23C 4/134 |

FOREIGN PATENT DOCUMENTS

| | | | | |
|---|---|---|---|---|
| EP | 0961017 | A2 | | 12/1999 |
| GB | 1317534 | A | * | 5/1973 |
| JP | S59-126772 | A | | 7/1984 |
| JP | S62-099449 | A | | 5/1987 |
| JP | H02-194118 | A | | 7/1990 |
| JP | H03-272959 | A | | 12/1991 |
| JP | H10-110206 | A | | 4/1998 |
| JP | H11-343564 | A | | 12/1999 |
| JP | H11-350102 | A | | 12/1999 |
| JP | 2008-240072 | A | | 10/2008 |
| JP | 2013-010984 | A | | 1/2013 |
| WO | WO-2009/069829 | A1 | | 6/2009 |
| WO | WO-2021/132226 | A1 | | 7/2021 |

OTHER PUBLICATIONS

English language translation of the International Search Report mailed Oct. 4, 2022, for PCT/JP2022/027814.

* cited by examiner

| CROSS-SECTIONAL SEM-BEI | | BINARIZED IMAGE | PRECIPITATED CARBIDE |
|---|---|---|---|
| x1000 | x5000 | x5000 | AREA RATIO |
|  |  |  | 43.8% |

GAS-ATOMIZED POWDER, 20 wt% $Cr_7C_3$-CoNiCrAlY

GRANULATED SINTERED POWDER, 40 wt% $Cr_3C_2$-CoNiCrAlY

ATOMIZED POWDER, THERMAL SPRAY COATING, HEARTH ROLL, AND METHOD FOR PRODUCING HEARTH ROLL

TECHNICAL FIELD

The present invention relates to an atomized powder, a thermal spray coating, a hearth roll, and a method for producing a hearth roll.

This application claims priority on Japanese Patent Application No. 2021-122668 filed in Japan on Jul. 27, 2021, the entire contents of which are incorporated herein by reference.

BACKGROUND ART

In a heat treatment furnace such as a steel plate continuous annealing furnace, steel plate conveying rolls called hearth rolls are arranged. A steel plate is heat-treated in the furnace, and in this case, adhering matter called buildup may be formed on the surface of each hearth roll due to a reaction with the steel plate.

When buildup is formed, push defects and the like occur on the surface of the steel plate being conveyed on the hearth rolls, resulting in poor quality of the steel sheet. Therefore, when buildup occurs, it is necessary to immediately stop the operation to clean the surfaces of the rolls, which significantly reduces the production efficiency.

Therefore, a thermal spray coating is provided on the surface of each hearth roll to prevent occurrence of buildup (see, for example, PATENT LITERATURES 1 to 3).

Thermal spray powders used in PATENT LITERATURES 1 to 3 contain a chromium carbide and a heat-resistant metal.

In addition, in PATENT LITERATURE 4, a chromium carbide-based thermal spray powder that is a thermal spray powder including a chromium carbide and a metal phase and in which the metal phase is formed by dispersion-strengthening a metal or alloy base thereof with fine ceramic hard particles at a volume ratio of 0.5 to 15% to the metal phase, is proposed as a thermal spray powder for forming a thermal spray coating having a high hardness even at high temperatures.

CITATION LIST

Patent Literature

PATENT LITERATURE 1: Japanese Laid-Open Patent Publication No. S59-126772

PATENT LITERATURE 2: Japanese Laid-Open Patent Publication No. 2008-240072

PATENT LITERATURE 3: International Publication No. WO2009/069829

PATENT LITERATURE 4: Japanese Laid-Open Patent Publication No. S62-099449

SUMMARY OF THE INVENTION

Technical Problem

The thermal spray powders proposed in PATENT LITERATURES 1 to 4 are each a thermal spray powder produced by a granulation sintering method. The primary particles of the chromium carbide and the heat-resistant alloy powder in the thermal spray powder produced by the granulation sintering method are small, and the thermal spray powder is porous and has a large specific surface area.

Therefore, a thermal spray coating formed using this thermal spray powder is likely to be oxidized. When a thermal spray coating is provided on the surface of a hearth roll using this thermal spray powder, there is a problem that the surface of the roll is oxidized early, so that buildup, in which foreign matter adheres to and grows on the surface of the roll, and pickup, in which foreign matter bites into the surface of the roll, are likely to occur.

In addition, the thermal spray coatings proposed in PATENT LITERATURES 1 to 4 have uneven chromium carbide distribution and size, and have locations where hardness is partially low, and in this regard, there is also a problem that pickup and buildup are likely to occur.

Solution to Problem

The present inventors have conducted an intensive study to solve these problems, have found that the above problems can be solved by using an atomized powder having a specific composition as a thermal spray powder, and have completed the present invention.

(1) An atomized powder according to one aspect of the present invention is an atomized powder including a heat-resistant alloy phase and a $Cr_7C_3$ phase dispersed in the heat-resistant alloy phase, wherein the atomized powder contains 20 to 46% of Ni, 22 to 43% of Cr, 4 to 13% of Al, 0.1 to 1.0% of Y, and 0.3 to 4.2% of C on a mass basis, and a remainder thereof includes Co and unavoidable impurities.

According to the atomized powder, a coating having excellent high temperature hardness, oxidation resistance, toughness, and thermal shock resistance is obtained by forming a thermal spray coating using the atomized powder.

(2) In the atomized powder of (1) above, preferably, the heat-resistant alloy phase is a Co-based alloy phase.

(3) In the atomized powder of (1) or (2) above, preferably, a part of the $Cr_7C_3$ phase is a needle-like structure.

(4) In the atomized powder of any one of (1) to (3) above, preferably, a proportion of the $Cr_7C_3$ phase in a cross-sectional structure of each particle is not greater than 50 area %.

The atomized powder having one or more of the above configurations (2) to (4) is suitable as a thermal spray powder for forming a thermal spray coating having a high hardness and having small variation in hardness from area to area.

(5) A thermal spray coating according to one aspect of the present invention is a thermal spray coating formed using the atomized powder of any one of (1) to (4) above.

(6) Another thermal spray coating according to one aspect of the present invention is a thermal spray coating including a heat-resistant alloy phase and a $Cr_7C_3$ phase dispersed in the heat-resistant alloy phase, wherein the heat-resistant alloy phase includes Co, Ni, Cr, Al, Y, and unavoidable impurities, and the thermal spray coating contains not less than 5 mass % and less than 30 mass % of $Cr_7C_3$ in total.

(7) In the thermal spray coating of (6) above, preferably, the heat-resistant alloy phase is a Co-based alloy phase.

(8) In the thermal spray coating of (6) or (7) above, preferably, a part of the $Cr_7C_3$ phase is a needle-like structure.

These thermal spray coatings have excellent high temperature hardness, oxidation resistance, toughness, and thermal shock resistance.

(9) A hearth roll according to one aspect of the present invention is a hearth roll including a roll body and a thermal spray coating, the thermal spray coating being provided on a surface thereof, wherein the thermal spray coating is the thermal spray coating of any one of (5) to (8) above.

In the hearth roll, the thermal spray coating provided on the surface thereof has excellent high temperature hardness, oxidation resistance, toughness, and thermal shock resistance.

Therefore, occurrence of pickup and buildup on the surface of the hearth roll (surface in contact with a steel plate) can be suppressed.

(10) A method for producing a hearth roll according one aspect of the present invention is a method for producing a hearth roll including a roll body and a thermal spray coating, the thermal spray coating being provided on a surface thereof, the method including:

forming a thermal spray coating on a surface of the roll body using the atomized powder according to any one of (1) to (4) above; and then hardening the thermal spray coating by heat-treating the thermal spray coating.

In the method for producing the hearth roll, since the heat treatment is performed on the formed thermal spray coating, a finer chromium carbide is precipitated in the heat-resistant alloy phase, so that the produced hearth roll can have further improved coating hardness and can have further improved wear resistance.

(11) The method for producing the hearth roll preferably includes decreasing a hardness of the heat-treated thermal spray coating by melting and solidifying a surface of the heat-treated thermal spray coating by applying a laser beam to the thermal spray coating after heat-treating the thermal spray coating.

In this case, by the laser treatment, the surface of the thermal spray coating becomes smooth, and the surface layer of the thermal spray coating becomes a dense structure. As a result, the possibility of occurrence of pickup and buildup can be further reduced.

Furthermore, when the thermal spray coating formed using the atomized powder is heat-treated and then the laser treatment is performed on the surface thereof, the fine chromium carbide structure in the surface layer is eliminated, the hardness of the thermal spray coating is decreased, the toughness of the thermal spray coating is improved, and a coating structure having thermal shock resistance is obtained.

In addition, by the above laser treatment, the heat-resistant alloy phase and the chromium carbide are melted, so that the surface layer portion of the thermal spray coating has a uniform composition, the unevenness of oxidation resistance is eliminated, and the oxidation resistance of the thermal spray coating is improved.

Advantageous Effects of the Invention

According to the present invention, it is possible to provide a thermal spray coating having excellent high temperature hardness, oxidation resistance, toughness, and thermal shock resistance, a thermal spray powder for obtaining such a thermal spray coating, and a hearth roll including the thermal spray coating.

DETAILED DESCRIPTION

Figure 1:
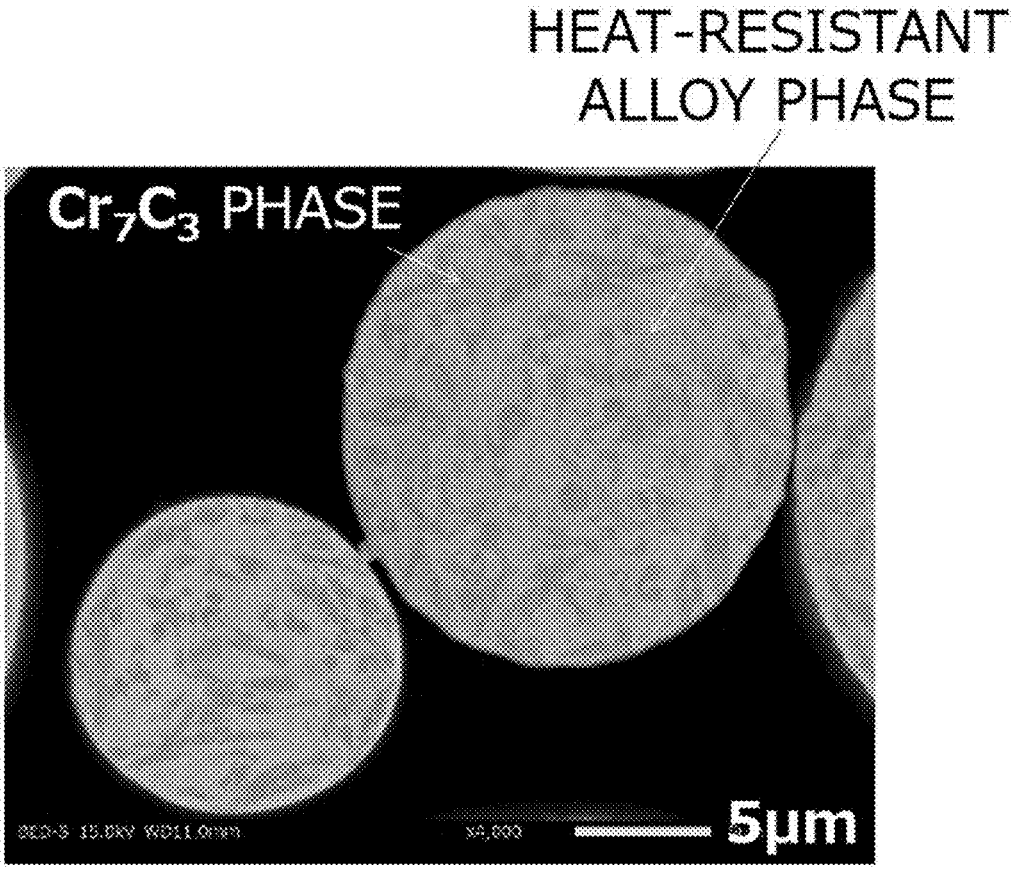
FIG. 1 is a cross-sectional SEM photograph of an example of an atomized powder according to an embodiment of the present invention.

Hereinafter, embodiments of the present invention will be described with reference to the drawings.

<Atomized Powder>

An atomized powder according to an embodiment of the present invention is an atomized powder having a heat-resistant alloy phase and a $Cr_7C_3$ phase. The heat-resistant alloy phase is preferably a Co-based alloy phase.

The atomized powder is a powder produced using an atomization method, and has a structure in which a fine chromium carbide is uniformly dispersed and precipitated in the heat-resistant alloy phase.

Unlike a powder produced by granulating and sintering a chromium carbide and a heat-resistant alloy, the atomized powder has a structure in which a fine chromium carbide ($Cr_7C_3$) is uniformly dispersed and precipitated in the heat-resistant alloy phase.

Therefore, by forming a thermal spray coating with the atomized powder as a thermal spray powder, the obtained thermal spray coating has a high hardness over the entire coating and has small variation in hardness from area to area.

Unlike a powder produced by a granulation sintering method (hereinafter, referred to as granulated sintered powder), the atomized powder is a solid powder and thus has a small specific surface area. Therefore, the atomized powder has higher oxidation resistance than a granulated sintered powder. In addition, a thermal spray coating formed using the atomized powder has better oxidation resistance than a thermal spray coating formed using a granulated sintered powder.

In the atomized powder, the chromium carbide is $Cr_7C_3$.

$Cr_7C_3$ is more stable in high temperature environments than $Cr_3C_2$. Therefore, a thermal spray coating with $Cr_7C_3$ formed using the atomized powder is less likely to change over time even when exposed to a high temperature environment.

When a thermal spray coating formed using a thermal spray powder having $Cr_3C_2$ and a heat-resistant alloy is exposed to a high temperature environment, $Cr_3C_2$ changes to $Cr_7C_3$. When such a change occurs, Cr becomes insufficient in a heat-resistant alloy phase, which may cause a decrease in the oxidation resistance of the thermal spray coating. In addition, when $Cr_3C_2$ in the thermal spray coating changes to $Cr_7C_3$, the dispersibility of the chromium carbide is impaired, and the hardness of the thermal spray coating may be varied.

In contrast, in the thermal spray coating with $Cr_7C_3$ formed using the atomized powder, a uniform dispersion state of the chromium carbide phase ($Cr_7C_3$ phase) is maintained even in a high temperature environment. Therefore, even when the content of the chromium carbide in the thermal spray coating is less than 30 mass %, the hardness can be maintained. In addition, in the thermal spray coating, Cr in the heat-resistant alloy phase is not reduced, and thus the oxidation resistance and the toughness of the thermal spray coating are not impaired. Furthermore, the thermal spray coating can contain a sufficient amount of the heat-resistant alloy phase (e.g., 70 mass % or more), and thus can exhibit excellent thermal shock resistance.

The atomized powder contains 20 to 46% of Ni, 22 to 43% of Cr, 4 to 13% of Al, 0.1 to 1.0% of Y, and 0.3 to 4.2% of C on a mass basis, and the remainder thereof includes Co and unavoidable impurities.

The atomized powder having such a composition is designed such that $Cr_7C_3$ is contained in an amount of not less than 5 mass % and less than 30 mass % in the powder.

If the content of $Cr_7C_3$ in the atomized powder is less than 5 mass %, the precipitation amount of the chromium carbide may become insufficient, and a sufficient hardness cannot be obtained in some cases.

On the other hand, if the content of $Cr_7C_3$ in the atomized powder is not less than 30 mass %, the content of the heat-resistant alloy phase in the atomized powder may become lower, and the thermal shock resistance of the thermal spray coating formed using the atomized powder may be insufficient. In addition, it is difficult to produce, by an atomization method, a powder having a heat-resistant alloy phase and a $Cr_7C_3$ phase and containing 30 mass % or more of $Cr_7C_3$.

Examples of the heat-resistant alloy include alloys containing Co, Ni, Cr, Al, and Y. Specific examples of the heat-resistant alloy include CoNiCrAlY alloys, NiCoCrAlY alloys, etc.

The atomized powder contains predetermined amounts of Ni, Cr, Al, Y, and C as constituent elements. The reasons for this are as follows.

Ni: 20 to 46 Mass %

In the atomized powder, Ni is a basic constituent element along with Co, and is contained to impart heat resistance and oxidation resistance.

If the content of Ni is less than 20 mass %, toughness is decreased and oxidation resistance is inferior. On the other hand, if the content of Ni exceeds 46 mass %, the contents of Cr and Al are reduced, and thus oxidation resistance is inferior.

Cr: 22 to 43 Mass %

In the atomized powder, Cr is contained to precipitate the chromium carbide and to form an oxide coating having excellent protective properties.

If the content of Cr is less than 22 mass %, the precipitation amount of the chromium carbide is insufficient, and a sufficient coating hardness cannot be obtained. In addition, oxidation resistance is also inferior.

On the other hand, if the content of Cr exceeds 43 mass %, toughness is impaired.

In addition, nozzle clogging is likely to occur during production by the atomization method, making the production difficult.

Al: 4 to 13 Mass %

In the atomized powder, Al is contained to form an oxide coating having excellent protective properties.

If the content of Al is less than 4 mass %, it is difficult to form a dense $Al_2O_3$ layer on the coating surface. On the other hand, if the content of Al exceeds 13 mass %, the coating becomes brittle and has inferior thermal shock resistance.

Y: 0.1 to 1.0 Mass %

In the atomized powder, Y is contained to stably form an oxide coating having excellent protective properties and to prevent peeling.

If the content of Y is less than 0.1 mass %, the effect of the addition is not exhibited. On the other hand, if the content of Y exceeds 1.0 mass %, the coating becomes brittle and has inferior oxidation resistance.

C: 0.3 to 4.2 Mass %

In the atomized powder, C is contained to precipitate the chromium carbide.

If the content of C is less than 0.3 mass %, the precipitation amount of the chromium carbide is insufficient, and a sufficient coating hardness cannot be obtained.

On the other hand, if the content of C exceeds 4.2 mass %, toughness is impaired. In addition, nozzle clogging is likely to occur during production by the atomization method, making the production difficult.

Unlike a granulated sintered powder, in the atomized powder, the chromium carbide is uniformly dispersed.

FIG. 1 is a cross-sectional SEM photograph of an example (see 20 wt % $Cr_7C_3$—CoNiCrAlY/Example 1) of the atomized powder according to the embodiment of the present invention.

Figure 2:
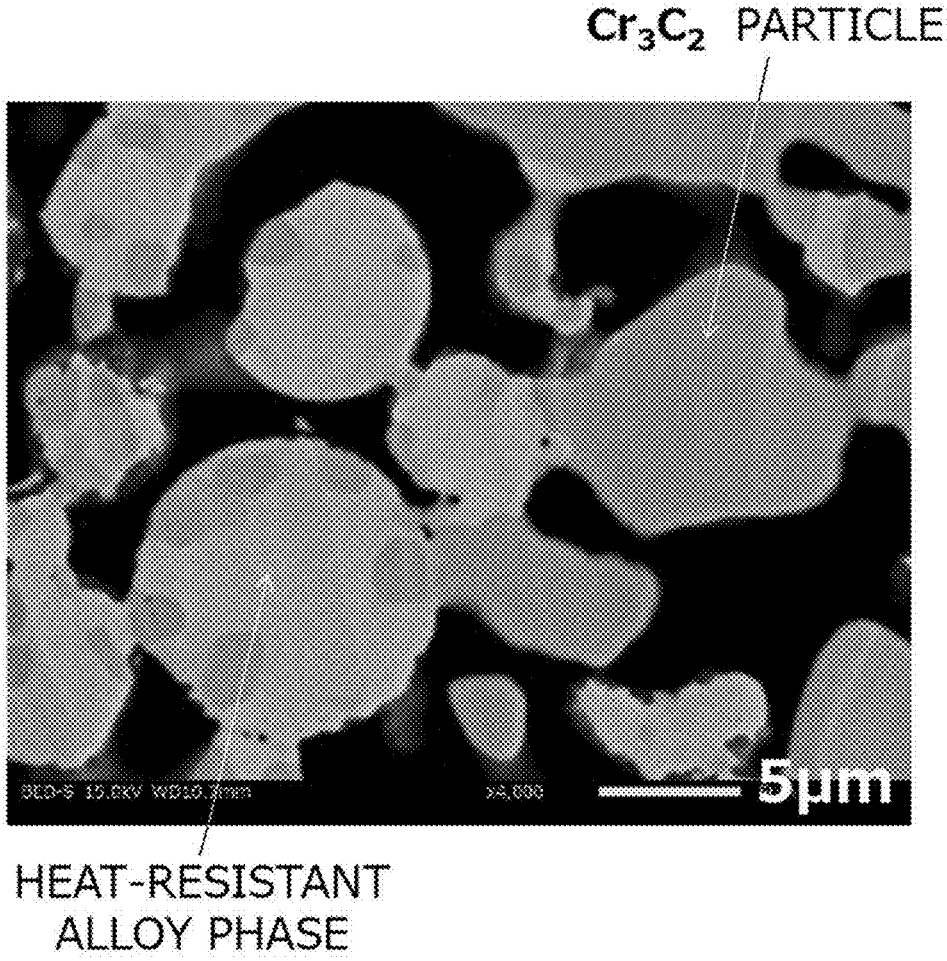
FIG. 2 is a cross-sectional SEM photograph of an example of a granulated sintered powder.

FIG. 2 is a cross-sectional SEM photograph of a granulated sintered powder (see 40 wt % $Cr_3C_2$—CoNiCrAlY/Comparative Example 1).

In the atomized powder, as is obvious from the cross-sectional SEM image shown in FIG. 1, a fine $Cr_7C_3$ phase is dispersed as the chromium carbide phase in the heat-resistant alloy phase (Co-based alloy phase) in each particle.

Meanwhile, as shown in FIG. 2, in the granulated sintered powder, a coarse chromium carbide ($Cr_3C_2$ particles) separated from a heat-resistant alloy phase is observed, and no fine $Cr_7C_3$ phase dispersed in the heat-resistant alloy phase as in FIG. 1 is observed.

In the atomized powder, a part of the $Cr_7C_3$ phase dispersed in the heat-resistant alloy phase (Co-based alloy phase) observed by an SEM is preferably is a needle-like structure.

The atomized powder preferably includes many needle-like structures having an aspect ratio of not less than 2 and not greater than 100 as the above needle-like structure. Here, the aspect ratio of each needle-like structure is the ratio of the length of a major axis portion to the length of a minor axis portion of the needle-like structure.

The atomized powder in which the needle-like structures of the $Cr_7C_3$ phase having the above aspect ratio are dispersed is suitable as a thermal spray powder for forming a thermal spray coating having a high hardness and having small variation in hardness from area to area.

An example of the length of the minor axis of each needle-like structure of the $Cr_7C_3$ phase is not greater than 8 μm and preferably not greater than 3 μm. Meanwhile, an example of the length of the minor axis of each needle-like structure is not less than 0.1 μm. In this case, the $Cr_7C_3$ phase can be said to be a microstructure.

An example of the distance between the adjacent needle-like structures (distance between the nearest neighboring portions) of the $Cr_7C_3$ phase is not greater than 5 μm. Meanwhile, an example of the distance between the adjacent needle-like structures (distance between the nearest neighboring portions) of the $Cr_7C_3$ phase is not less than 0.1 μm. In this case, the $Cr_7C_3$ phase can be said to have excellent uniform dispersibility.

For the atomized powder, the proportion of the $Cr_7C_3$ phase in a cross-sectional structure of each particle is preferably not greater than 50 area %. If this proportion exceeds 50 area %, the uniform dispersibility of $Cr_7C_3$ is inferior. Meanwhile, the proportion of the $Cr_7C_3$ phase in the cross-sectional structure of each particle is preferably not less than 20 area %. If this proportion is less than 20 area %, it is difficult to obtain a sufficient coating hardness.

The proportion of the $Cr_7C_3$ phase in the cross-sectional structure of each particle can be calculated from a cross-sectional SEM image of the atomized powder.

Examples of the atomization method include a gas atomization method, a water atomization method, a disc atomization method, etc.

In the atomization method, the produced powder may be classified by a sieve to adjust the particle size.

In the gas atomization method, a raw material metal is heated and melted to obtain molten metal. This molten metal flows out from a nozzle. A gas (argon gas, nitrogen gas, or the like) is sprayed to this molten metal.

The energy of the gas turns the molten metal into droplets, and the droplets are cooled while being caused to fall. The droplets solidify to form particles.

The water atomization method is a method in which water is sprayed instead of the gas in the gas atomization method.

In the disc atomization method, a raw material metal is heated and melted to obtain molten metal. This molten metal flows out from a nozzle. This molten metal is dropped onto a disc rotating at a high speed. The molten metal is rapidly cooled and solidifies to obtain a powder.

The gas atomization method is preferable as the atomization method.

In the gas atomization method, since the molten metal is instantaneously formed into droplets and cooled at the same time, a uniform microstructure is obtained. Moreover, since the droplets are formed continuously, the composition difference between particles is very small. This is one of the reasons why the gas atomization method is preferable.

<Thermal Spray Coating>

A thermal spray coating according to an embodiment of the present invention contains a heat-resistant alloy phase and a $Cr_7C_3$ phase dispersed in the heat-resistant alloy phase, the heat-resistant alloy phase includes Co, Ni, Cr, Al, Y, and unavoidable impurities, and the thermal spray coating contains not less than 5 mass % and less than 30 mass % of $Cr_7C_3$ in total.

$Cr_7C_3$ is more stable in high temperature environments than $Cr_3C_2$. Therefore, the thermal spray coating is less likely to change over time even when exposed to a high temperature environment.

In addition, in the thermal spray coating having $Cr_7C_3$ as a chromium carbide, a uniform dispersion state of the chromium carbide phase is maintained even in a high temperature environment. Therefore, the thermal spray coating can maintain hardness even when the content of the chromium carbide in the coating is less than 30 mass %. Moreover, in the thermal spray coating, Cr in the heat-resistant alloy phase is not reduced even in a high temperature environment, so that the oxidation resistance and the toughness of the thermal spray coating are not impaired. Furthermore, the thermal spray coating can contain not less than 70 mass % of the heat-resistant alloy phase and therefore has excellent thermal shock resistance.

The thermal spray coating contains not less than 5 mass % and less than 30 mass % of $Cr_7C_3$ in total.

If the content of the above $Cr_7C_3$ is less than 5 mass %, the hardness and the heat resistance of the thermal spray coating may be insufficient.

On the other hand, if the content of the above $Cr_7C_3$ is not less than 30 mass %, the amount of the heat-resistant alloy phase in the thermal spray coating may become small, and the thermal shock resistance of the thermal spray coating may become insufficient.

Preferably, the composition of the thermal spray coating contains 20 to 46% of Ni, 22 to 43% of Cr, 4 to 13% of Al, 0.1 to 1.0% of Y, and 0.3 to 4.2% of C on a mass basis, and the remainder thereof includes Co and unavoidable impurities.

Such a composition is suitable for making a thermal spray coating having excellent high temperature hardness, oxidation resistance, toughness, and thermal shock resistance.

The thermal spray coating can be produced by thermal spraying using the above atomized powder as a thermal spray powder.

A thermal spray coating formed using the atomized powder is also one aspect of the present invention.

The thermal spraying method for forming the thermal spray coating is not particularly limited, and, for example, high velocity oxygen-fuel thermal spraying (HVOF) or the like can be used.

In the above HVOF, a fuel gas is usually any of kerosene, $C_3H_8$, $C_2H_2$, and $C_3H_6$. The pressure of the fuel gas may be 0.1 to 1 MPa, and the flow rate of the fuel gas may be 10 to 500 l/min. The pressure of oxygen gas may be 0.1 to 1 MPa, and the flow rate of oxygen gas may be 100 to 1200 l/min.

<Hearth Roll and Production Method Therefor>

Figure 3:
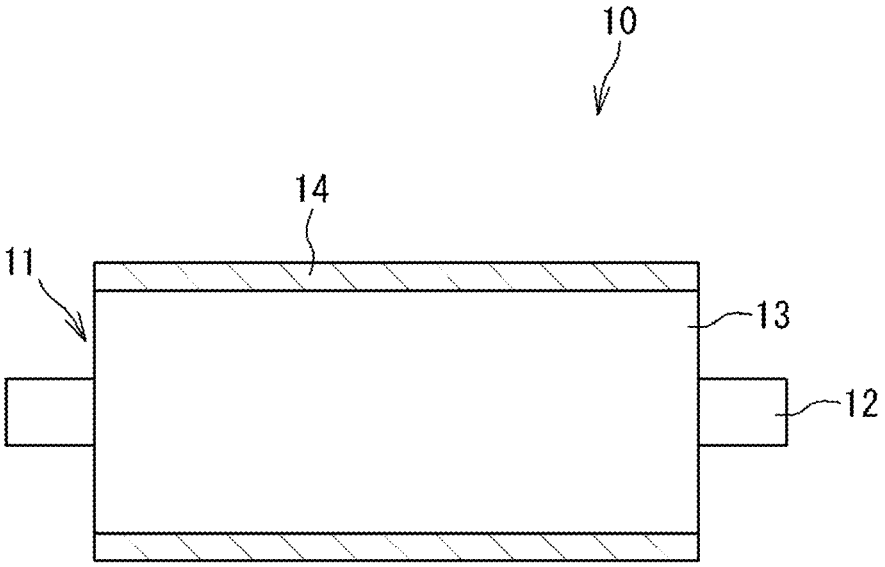
FIG. 3 is a diagram showing an example of a hearth roll according to an embodiment of the present invention.

FIG. 3 is a diagram showing an example of a hearth roll according to an embodiment of the present invention.

As shown in FIG. 3, a hearth roll 10 according to the embodiment of the present invention includes a roll body 11 and a thermal spray coating 14.

The roll body 11 includes a roll shaft 12 and a roll base material 13 mounted on the roll shaft 12.

The thermal spray coating 14 is provided on the surface (peripheral surface) of the roll base material 13.

The hearth roll 10 serves as a steel plate conveying roll for conveying a steel plate. The hearth roll 10 conveys a steel plate by bringing the peripheral surface of the hearth roll 10 (surface of the thermal spray coating 14) into contact with the steel plate while rotating around the roll shaft 12.

The roll base material 13 is formed of a metal, such as steel, for example.

For example, stainless steel-based heat-resistant cast steel or the like is used as the above metal.

The thermal spray coating 14 is the thermal spray coating according to the embodiment of the present invention described above.

Therefore, the hearth roll 10 is less likely to cause pickup and buildup on the peripheral surface thereof.

The thickness of the thermal spray coating 14 is preferably not less than 20 μm and not greater than 300 μm.

If the thickness of the thermal spray coating 14 is less than 20 μm, the effect of providing the thermal spray coating (suppression of occurrence of buildup or pickup) cannot be sufficiently obtained. On the other hand, if the thickness of the thermal spray coating 14 exceeds 300 μm, the thermal spray coating is likely to be broken due to the thermal expansion difference with the roll base material.

As a method for producing the hearth roll 10, for example, a production method in which a thermal spray coating is formed on the surface of the roll body 11 using the above atomized powder can be employed.

In the method for producing the hearth roll 10, it is preferable to harden the thermal spray coating by heat treatment after the formation of the thermal spray coating. By heat-treating the thermal spray coating, the hardness can be increased as compared to the thermal spray coating before heat treatment.

The heat treatment may be performed, for example, under a condition of heating at 300° C. or higher and 600° C. or lower for 1 hour or longer and 10 hours or shorter. The heating temperature is more preferably 400° C. or higher.

The heat treatment may be performed in an oxidizing atmosphere (e.g., in atmospheric air) or in a non-oxidizing atmosphere. An example of the method of the treatment in a non-oxidizing atmosphere is a method in which a roll body having a thermal spray coating formed thereon is placed in a heating furnace with an inert gas atmosphere such as nitrogen or argon and the treatment is performed.

By performing the above heat treatment, an even finer chromium carbide ($Cr_7C_3$) is precipitated in the heat-resistant alloy phase of the thermal spray coating. As a result, the hardness of the thermal spray coating is further improved, and the wear resistance of the thermal spray coating is further improved.

In the method for producing the hearth roll 10, it is preferable to melt and solidify the surface of the heat-treated thermal spray coating by further irradiating the thermal spray coating with a laser beam after the above heat treatment. Accordingly, the hardness of the heat-treated thermal spray coating is decreased.

When the above laser treatment is performed, the fine chromium carbide ($Cr_7C_3$) structure in the surface layer of the thermal spray coating is eliminated, and the hardness of the thermal spray coating is decreased. Meanwhile, the laser-treated thermal spray coating has improved toughness, and becomes a coating having excellent thermal shock resistance.

In addition, when the above laser treatment is performed, the surface of the thermal spray coating becomes smooth, and the surface layer becomes a dense structure. As a result, pickup and buildup are further less likely to occur.

Moreover, when the above laser treatment is performed, the heat-resistant alloy phase and the chromium carbide melt and solidify, so that the once-melted portion of the thermal spray coating has a uniform composition. As a result, the oxidation resistance of the thermal spray coating is improved.

The conditions of the above laser treatment are not particularly limited, and the laser treatment may be performed under conditions where a part of the thermal spray coating is melted.

Examples of a laser used in the above laser treatment include fiber lasers, Nd/YAG lasers, disk lasers, etc.

The depth of the thermal spray coating to be melted by the above laser treatment may be, for example, not less than 5 μm and not greater than 20 μm.

The embodiments disclosed herein are merely illustrative and not restrictive in all aspects. The technical scope of the present invention is defined by the scope of the claims rather than the meaning described above, and is intended to include meaning equivalent to the scope of the claims and all modifications within the scope.

EXAMPLES

Hereinafter, the embodiments of the present invention will be more specifically described by means of examples, but the embodiments of the present invention are not limited to the examples below.

Here, a thermal spray coating was formed on the surface of a plate-shaped base material (made of austenitic stainless steel (SUS304), 50 mm long×50 mm wide×5 mm thick) by a high velocity oxygen-fuel (HVOF) thermal spraying method, and test pieces were produced. Furthermore, the obtained test pieces were subjected to heat treatment and laser treatment.

Example 1

1. Production of Thermal Spray Powder (Atomized Powder)

A 20 wt % $Cr_7C_3$—CoNiCrAlY (particle diameter−38/+10 μm) powder was produced as an atomized powder.

The raw materials weighed to provide a predetermined composition shown in Table 1 below were inductively melted in a refractory crucible in an argon atmosphere, and argon gas was sprayed to the molten metal flowing out of a nozzle at the bottom of the crucible. The molten metal was rapidly cooled and solidified to obtain a gas-atomized powder. The gas-atomized powder was classified to obtain a thermal spray powder.

TABLE 1

| Component | Ni | Cr | Al | Co | Y | C |
|---|---|---|---|---|---|---|
| 20 wt % $Cr_7C_3$—CoNiCrAlY | 25.6 | 34.1 | 6.4 | 30.7 | 0.48 | 2.67 |

2. Observation of Precipitated Carbide in Atomized Powder

Cross-sectional SEM-BEI observation of the above atomized powder was performed. In addition, image processing (binarization) was performed on observed images, and the area ratio of a precipitated carbide in the entire atomized powder was calculated.

Figure 4:
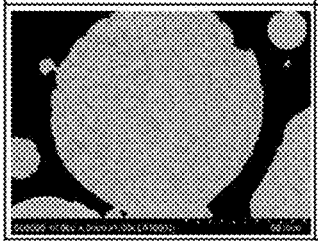
FIG. 4 is a diagram showing results of observation of a cross-section of an atomized powder of Example 1.
Figure 4:
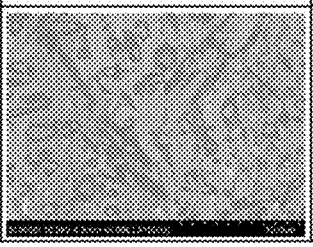
Figure 4:
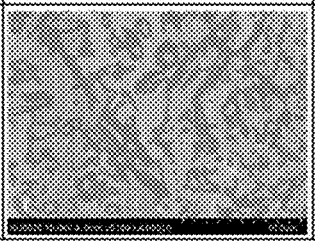

FIG. 4 shows cross-sectional SEM-BEI observation and binarized images of the atomized powder and the result of calculation of the area ratio of the precipitated carbide.

3. Thermal Spray Coating

The above atomized powder was used as a thermal spray powder, a thermal spray coating was formed on the surface of the above base material by a high velocity oxygen-fuel thermal spraying method, and test pieces were obtained.

JP-5000 (manufactured by Praxair/TAFA) was used as a high velocity oxygen-fuel thermal spraying device.

The details of the thermal spraying conditions in this example were as follows.

Oxygen: 896 L/min

Kerosene: 0.32 L/min

Thermal spraying distance: 380 mm

Raw material feed rate: 50 g/min

4. Heat Treatment of Thermal Spray Coating

The test pieces produced in 3. above were placed in a heating furnace, and heat treatment was performed thereon in atmospheric air.

Here, the heat treatment temperature was 400° C., 500° C., or 600° C., and the heat treatment time was 6 hours.

5. Laser Treatment

Of the test pieces on which the heat treatment had been performed in 4. above, the test piece on which heat treatment had been performed at 500° C. for 6 hours was further subjected to laser treatment.

Here, the laser treatment was performed under the following conditions.

Laser type: Yb-based fiber laser
Laser wavelength: 1070 nm
Power density: $1.4\times10^6$ W/cm$^2$
Output: 1000 W
Laser spot diameter: 300 μm in diameter Comparative Example 1

1. Thermal Spray Powder

A 40 wt % $Cr_3C_2$—CoNiCrAlY (particle diameter−53/+20 μm) powder produced by a granulation sintering method was prepared.

2. Thermal Spray Coating

The powder produced by the above granulation sintering method was used as a thermal spray powder, a thermal spray coating was formed on the surface of the above base material by a high velocity oxygen-fuel thermal spraying method under the same conditions as in Example 1, and test pieces were obtained.

3. Heat Treatment of Thermal Spray Coating

The test pieces were subjected to heat treatment under the same conditions as in Example 1.

4. Laser Treatment

Of the test pieces on which the heat treatment had been performed in 3. above, the test piece on which heat treatment had been performed at 500° C. for 6 hours was further subjected to laser treatment under the same conditions as in Example 1.

<Physical Property Evaluation>

1. Confirmation of Constituent Phases by XRD Analysis

The atomized powder, the thermal spray coating (before heat treatment), and the thermal spray coating (after laser treatment) produced in Example 1 were measured by XRD.

Figure 5:
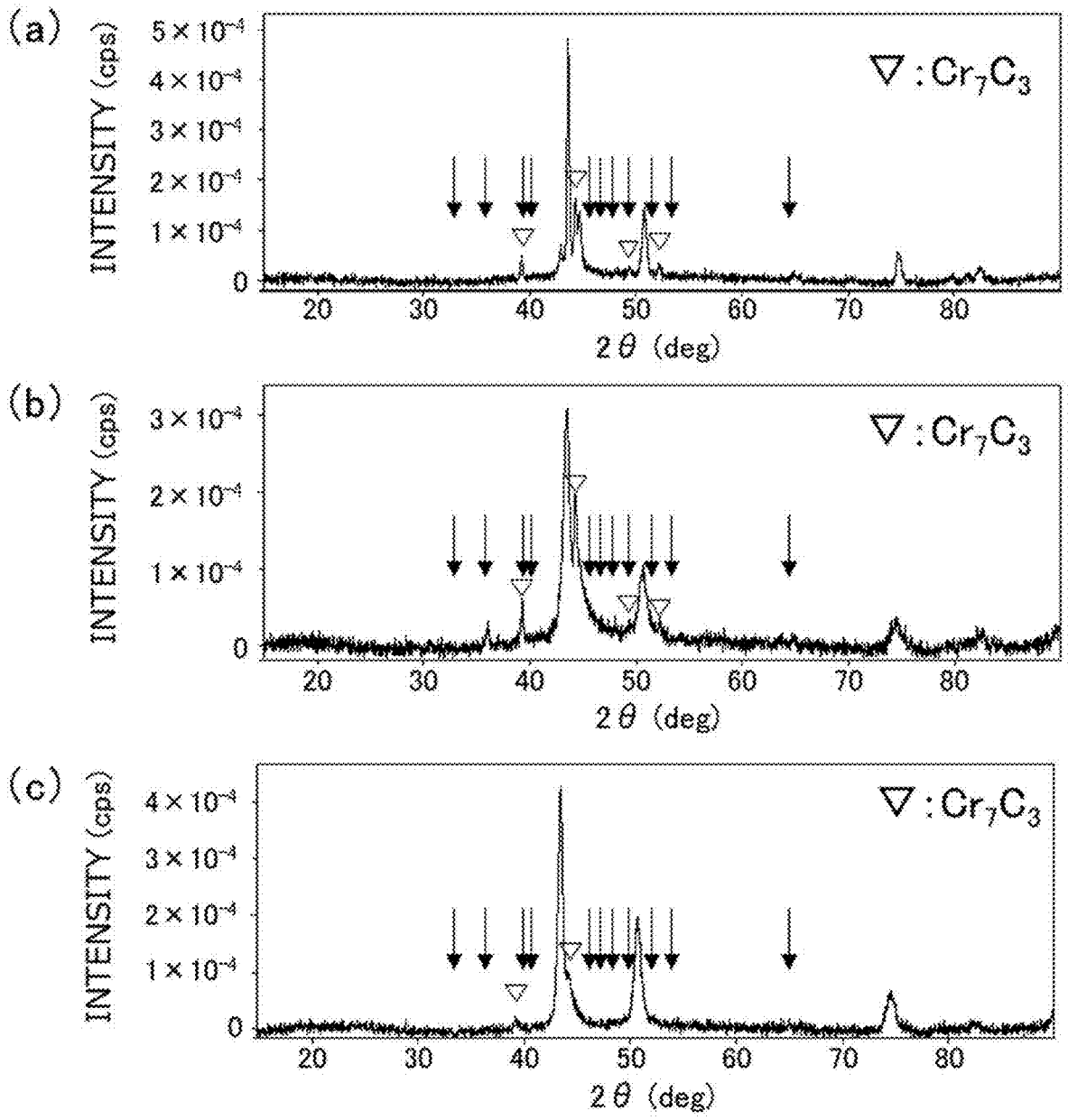
FIG. 5(*a*) to FIG. 5(*c*) are diagrams showing results of measurement by XRD of the atomized powder and a thermal spray coating produced in Example 1.

The results are shown in FIG. 5(*a*) to FIG. 5(*c*). FIG. 5(*a*) shows the measurement results of the atomized powder. FIG. 5(*b*) shows the measurement results of the thermal spray coating (before heat treatment). FIG. 5(*c*) shows the measurement results of the thermal spray coating (after laser treatment). In FIG. 5(*a*) to FIG. 5(*c*), downward arrows indicate peak positions of $Cr_3C_2$.

As shown in FIG. 5(*a*) to FIG. 5(*c*), the atomized powder and the thermal spray coating in Example 1 had $Cr_7C_3$, and no $Cr_3C_2$ was detected.

2. Hardness Evaluation (1) of Thermal Spray Coatings

The Vickers hardness of the surface layer of the thermal spray coating was measured for each of the test pieces in Example 1 and Comparative Example 1 (i) after the formation of the thermal spray coating and (ii) after heat treatment at a predetermined temperature (400° C., 500° C., 600° C.) for 6 hours after the formation of the thermal spray coating. The measurement was performed at 10 locations, and the average value was used as a coating hardness. The results are shown in FIG. 6.

The Vickers hardness was measured using a micro Vickers hardness tester under a condition of a load of 25 g.

Figure 6:
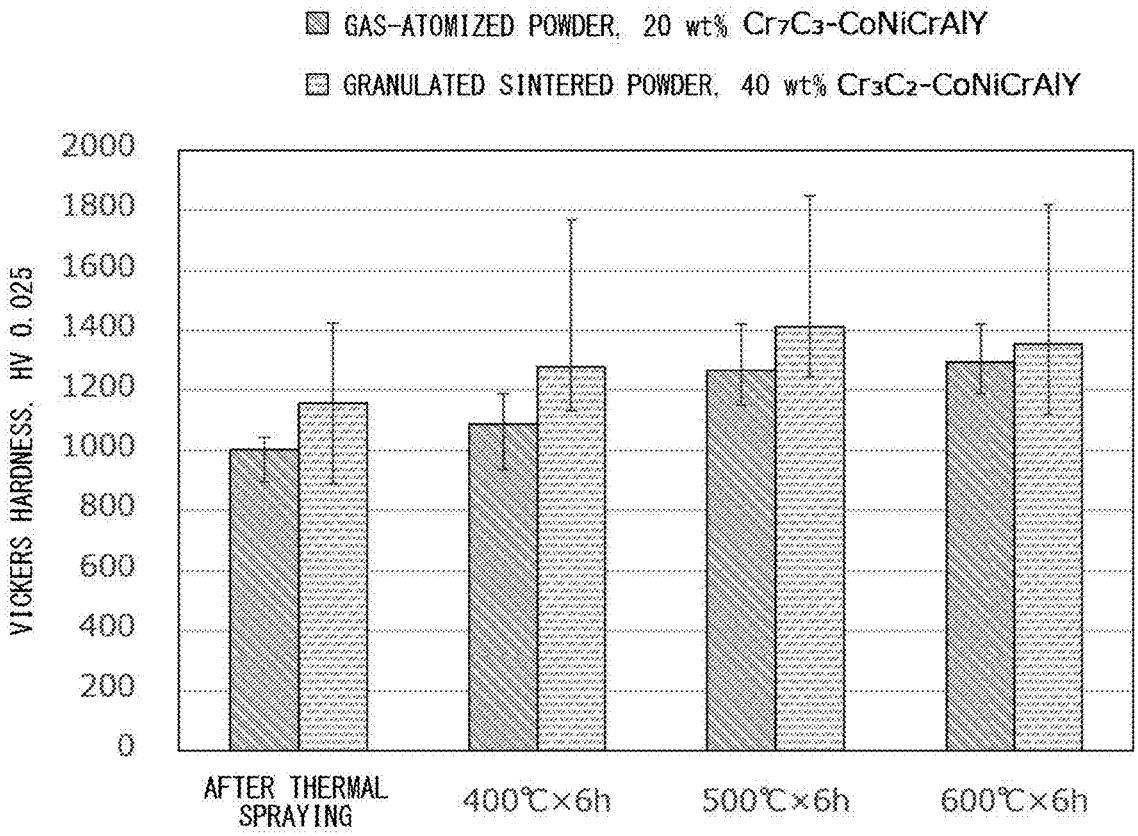
FIG. 6 is a graph showing results of hardness evaluation (1) of thermal spray coatings in examples.

As shown in FIG. 6, in both Example 1 (indicated as gas-atomized powder in the figure, the same applies to FIG. 7 to FIG. 9) and Comparative Example 1 (indicated as granulated sintered powder in the figure, the same applies to FIG. 7 to FIG. 9), the coating hardness was increased by performing the heat treatment after the formation of the thermal spray coating.

In addition, in Example 1, the variation in the hardness of the thermal spray coating was smaller than in Comparative Example 1 at all stages.

3. Hardness Evaluation (2) of Thermal Spray Coatings

The Vickers hardness of the surface layer of the thermal spray coating was measured for each of the test pieces in Example 1 and Comparative Example 1 (i) after the formation of the thermal spray coating, (ii) after heat treatment (500° C.×6 hours) after the formation of the thermal spray coating, and (iii) after laser treatment after the heat treatment. The measurement was performed at 10 locations, and the average value was used as a coating hardness. The results are shown in FIG. 7.

The Vickers hardness was measured using a micro Vickers hardness tester under a condition of a load of 25 g.

Figure 7:
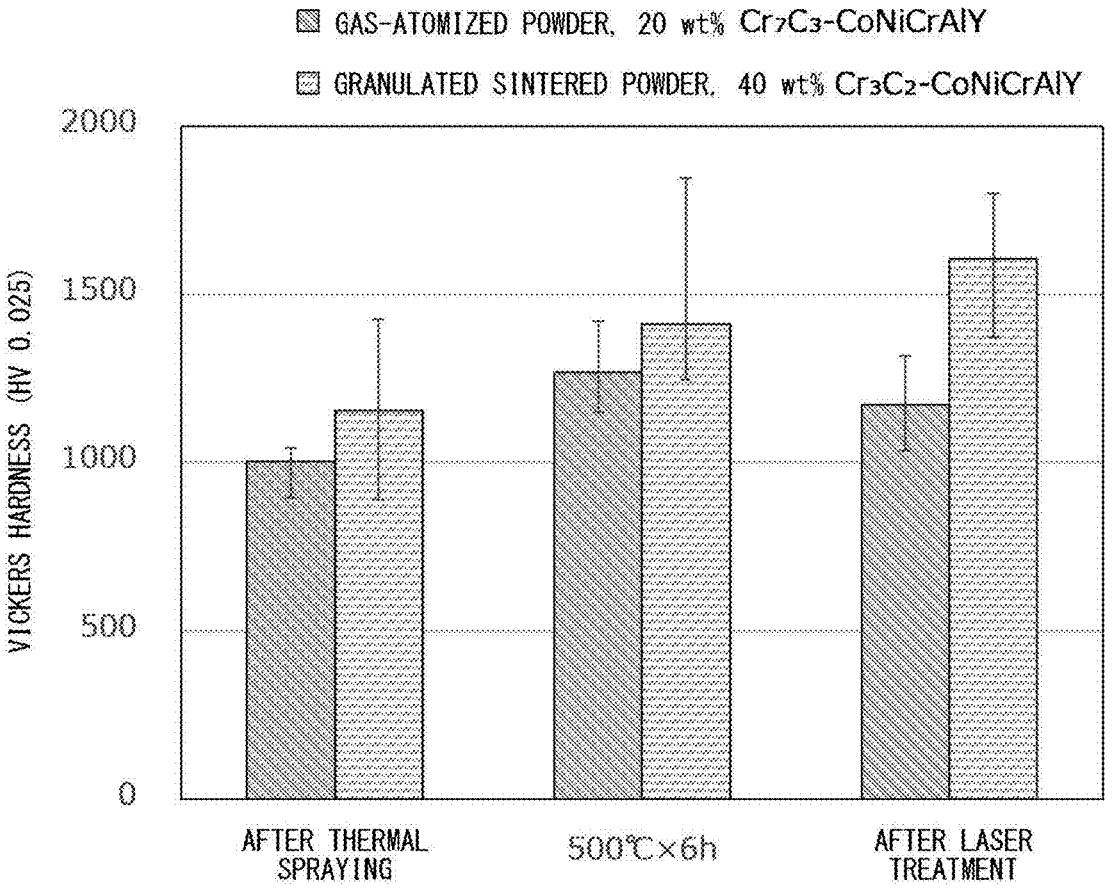
FIG. 7 is a graph showing results of hardness evaluation (2) of the thermal spray coatings in the examples.

As shown in FIG. 7, in Example 1, the coating hardness of the thermal spray coating increased once when the heat treatment was performed, but then decreased when the laser treatment was performed. On the other hand, in Comparative Example 1, the coating hardness of the thermal spray coating increased when the heat treatment was performed, and then further increased when the laser treatment was performed.

In addition, in Example 1, the variation in the hardness of the thermal spray coating was smaller than in Comparative Example 1 at all stages.

4. Observation of Thermal Spray Coatings

Cross-sections of the thermal spray coatings produced in Example 1 and Comparative Example 1 were observed using a scanning electron microscope (SEM).

Figure 8:
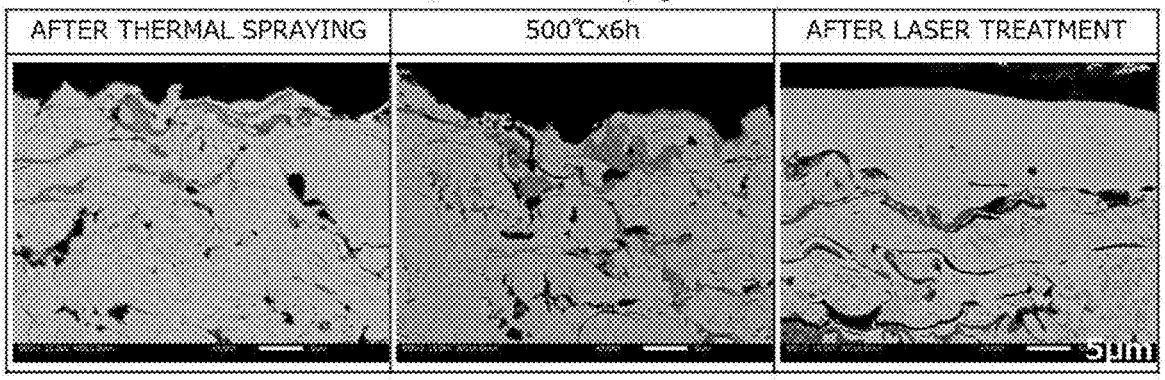
FIG. 8 shows SEM-BEI images of cross-sections of the thermal spray coatings of Example 1 and Comparative Example 1.
Figure 8:
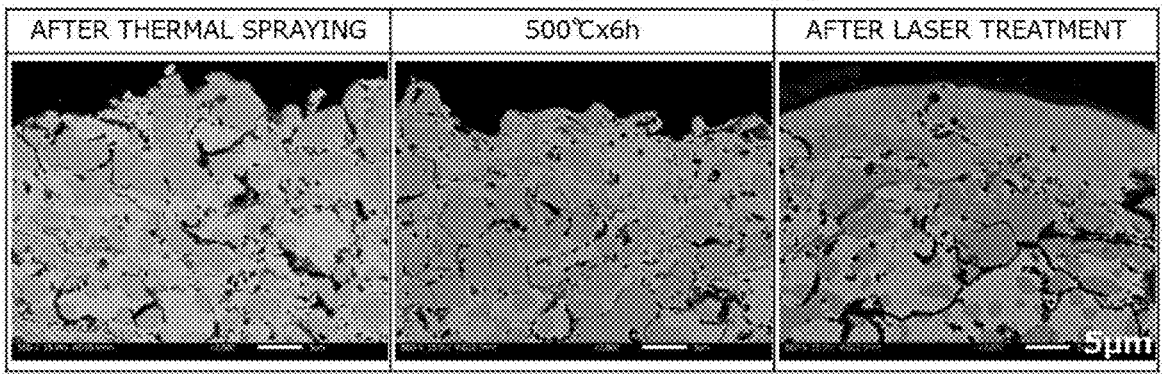

FIG. 8 shows cross-sectional SEM-BEI images of the thermal spray coatings produced in Example 1 and Comparative Example 1 at the respective stages. FIG. 8 shows observed images of the thermal spray coatings (i) after the formation of the thermal spray coating, (ii) after heat treatment (500° C.×6 hours) after the formation of the thermal spray coating, and (iii) after laser treatment after the heat treatment, for each of the thermal spray coatings produced in Example 1 and Comparative Example 1.

As seen from the observed images shown in FIG. 8, in the thermal spray coating in Example 1, the chromium carbide was maintained in a finer state and had fewer pores than in the thermal spray coating in Comparative Example 1 at all stages.

In addition, in Example 1, the surface layer of the thermal spray coating was melted and solidified by the laser treatment, and thus was densified and had a smooth surface. On the other hand, in Comparative Example 1, the surface of the thermal spray coating was smooth after the laser treatment, but the surface layer did not become a uniform structure.

5. Hardness Evaluation (3) of Thermal Spray Coatings

The Vickers hardness of a center portion of the thermal spray coating (portion that was not melted during laser treatment) was measured at room temperature and high temperatures for each of the test pieces subjected to the heat treatment and the laser treatment in Example 1 and Comparative Example 1.

Figure 9:
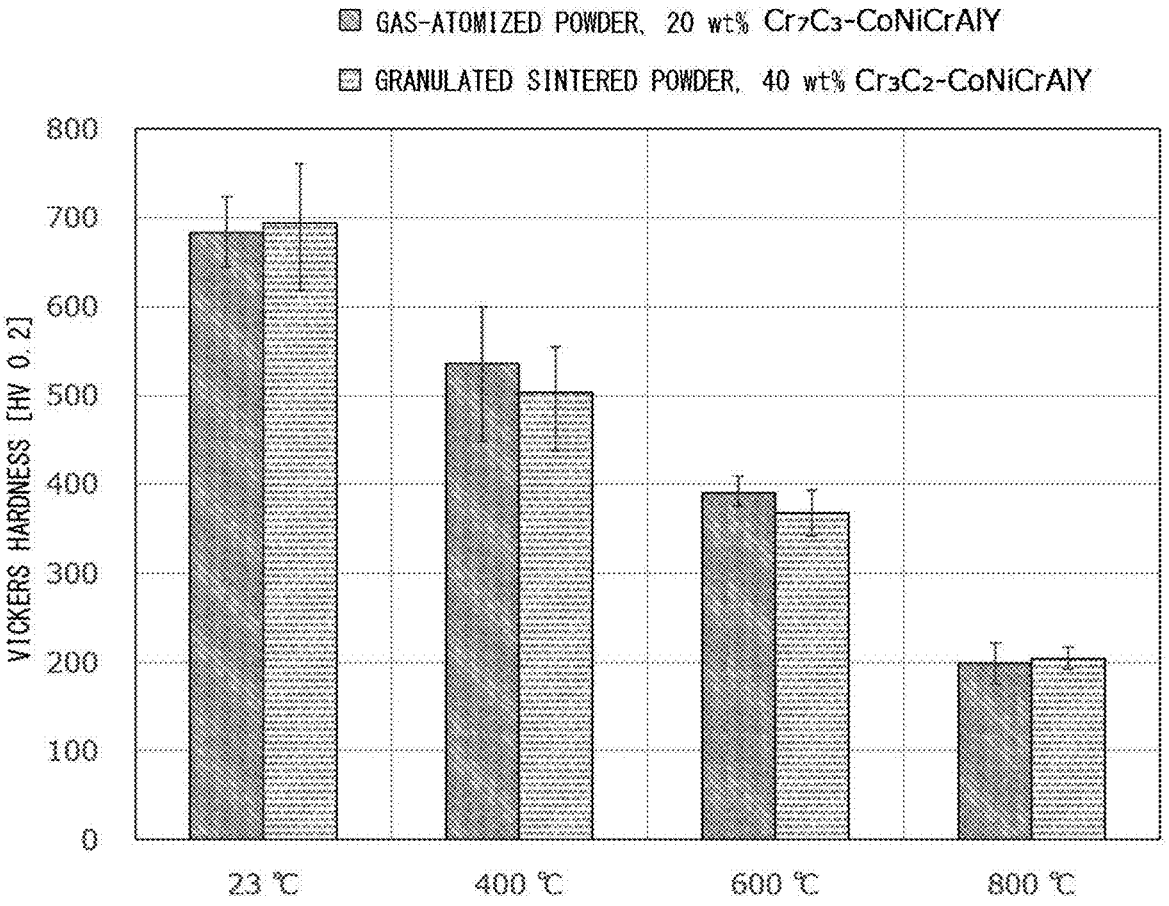
FIG. 9 is a graph showing results of hardness evaluation (3) of the thermal spray coatings in the examples.

Specifically, the Vickers hardness was measured in an Ar atmosphere at each of temperatures of 23° C., 400° C., 600° C., and 800° C. The measurement was performed at five locations, and the average value was used as a Vickers hardness at room temperature or high temperature. The results are shown in FIG. 9. The Vickers hardness was measured at room temperature and high temperatures using a high-temperature microscopic hardness tester under a condition of a load of 200 g.

As shown in FIG. 9, the thermal spray coating produced in Example 1 and the thermal spray coating produced in Comparative Example 1 did not have much difference in hardness therebetween, and both maintained a certain hardness in high temperature environments.

REFERENCE SIGNS LIST

10 hearth roll
11 roll body
12 roll shaft
13 roll base material
14 thermal spray coating

The invention claimed is:

1. An atomized powder comprising a heat-resistant alloy phase and a $Cr_7C_3$ phase dispersed in the heat-resistant alloy phase, wherein the heat-resistant alloy phase is a Co-based alloy phase, the atomized powder contains 20 to 46% of Ni, 22 to 43% of Cr, 4 to 13% of Al, 0.1 to 1.0% of Y, and 0.3 to 4.2% of C on a mass basis, and a remainder thereof includes Co and unavoidable impurities, and a content of $Cr_7C_3$ in the atomized powder is not less than 5 mass % and not greater than 20 mass %.

2. The atomized powder according to claim 1, wherein a part of the $Cr_7C_3$ phase is a needle-like structure.

3. The atomized powder according to claim 1, wherein a proportion of the $Cr_7C_3$ phase in a cross-sectional structure of a particle is not greater than 50 area %.

4. A thermal spray coating formed using the atomized powder according to claim 1.

5. A hearth roll comprising a roll body and a thermal spray coating, the thermal spray coating being provided on a surface thereof, wherein the thermal spray coating is the thermal spray coating according to claim 4.

6. A method for producing a hearth roll including a roll body and a thermal spray coating, the thermal spray coating being provided on a surface thereof, the method comprising:

forming a thermal spray coating on a surface of the roll body using the atomized powder according to claim 1; and then hardening the thermal spray coating by heat-treating the thermal spray coating.

7. The method for producing the hearth roll according to claim 6, further comprising decreasing a hardness of the heat-treated thermal spray coating by melting and solidifying a surface of the heat-treated thermal spray coating by applying a laser beam to the thermal spray coating after heat-treating the thermal spray coating.

* * * * *